US005842745A

United States Patent [19]

Kelly et al.

[11] Patent Number: 5,842,745

[45] Date of Patent: Dec. 1, 1998

[54] UPPER BODY SUPPORT FOR WHEELCHAIR

[75] Inventors: Robert L. Kelly, 5705 Sourwood La., Knoxville, Tenn. 37921; Wilford L. Kelly, Harriman, Tenn.

[73] Assignee: Robert L. Kelly, Knoxville, Tenn.

[21] Appl. No.: 929,815

[22] Filed: Sep. 15, 1997

[51] Int. Cl.[6] ..... A47C 7/54

[52] U.S. Cl. ..... 297/411.23; 297/466; 297/153; 297/DIG. 4

[58] Field of Search ..... 297/250.1, 304.1, 297/304.4, 227, 148, 153, DIG. 4, 440.1, 466, 464, 487, 411.23, 400.26, 118

[56] References Cited

U.S. PATENT DOCUMENTS

| | | | |
|---|---|---|---|
| 2,871,928 | 2/1959 | Swenson . | |
| 2,891,604 | 6/1959 | Soucie . | |
| 3,103,386 | 9/1963 | Kerr . | |
| 4,065,179 | 12/1977 | Takasaki | 297/384 |
| 4,223,944 | 9/1980 | DeLong | 297/148 |
| 4,428,616 | 1/1984 | Hamilton | 297/145 |
| 4,576,351 | 3/1986 | Brink . | |
| 4,623,194 | 11/1986 | Pillot | 297/316 |
| 4,632,451 | 12/1986 | Lee . | |
| 5,310,244 | 5/1994 | Borgardt . | |
| 5,326,154 | 7/1994 | Williamson et al. | 297/411 |
| 5,544,940 | 8/1996 | Stevens | 297/411 |
| 5,588,663 | 12/1996 | Rundle et al. | 280/304 |
| 5,713,591 | 2/1998 | Zarkhin et al. . | |

*Primary Examiner*—Milton Nelson, Jr.
*Attorney, Agent, or Firm*—Luedeka, Neely & Graham, PC

[57] ABSTRACT

An improved wheelchair and upper body support for supporting an occupant of the wheelchair. The wheelchair has two spaced-apart armrests for supporting the occupant. An upper body support is mounted on each of the spaced-apart armrests and includes a base member that has a front end and a back end. The upper body support further includes a padded backwall that is attached to the base member and that provides support for the occupant when an arm of the occupant is leaned thereon. The upper body support further includes a padded sidewall that is attached to the base member and provides support for the occupant when the occupant's arm is leaned thereon. A mechanism is also provided for securing each upper body support to one of the spaced-apart armrests. The padded backwall is removably attached to the base member so that the occupant may operate the wheelchair when the padded backwall is removed.

14 Claims, 3 Drawing Sheets

UPPER BODY SUPPORT FOR WHEELCHAIR

FIELD OF THE INVENTION

In general, the present invention relates to wheelchairs and, in particular, the present invention relates to an improved wheelchair and upper body support for an occupant of the wheelchair.

BACKGROUND

Wheelchairs are extensively employed as a way to increase mobility of the elderly and typically include basic functional components such as a frame, a seat, a back, two large wheels and two small wheels attached to the frame, handles for guiding the wheelchair by a non-occupant, a footrest, and armrests. Although current wheelchairs have become highly functional and mobile, one area in which wheelchairs are lacking are the armrests which are commonly attached to each side of the chair. For example, current armrests are generally made of a hard plastic material for durability, and the armrests are often very narrow in width. These hard, narrow armrests are uncomfortable and afford relatively little support for occupants who fall asleep in the wheelchair. Occupants who are either incapacitated or have trouble moving and positioning their arms frequently have their entire bodyweight leaned to one side of the wheelchair. In this position, the occupant's arms can easily slide off the armrests causing the occupant to be placed in an awkward, slouched position which may produce circulatory and respiratory problems for the occupant. This is a prevalent occurrence in nursing homes for the elderly.

Therefore, there is a need for a wheelchair which incorporates features for increasing both the comfort and safety of the wheelchair occupant. Such features should preferably include an upper body support which is padded and spacious. The upper body support should be defined by a bottom, a backwall, and a sidewall which support the occupant and prevent an arm of the occupant from sliding off the upper body support so that even an incapacitated occupant can sit within the confines of the wheelchair in a substantially upright position. As a further advantageous feature, the upper body support should be configured for easy attachment and removal with little or no alteration of the wheelchair.

SUMMARY OF THE INVENTION

The present invention provides an upper body support for an occupant of a wheelchair that has two spaced-apart armrests attached thereon for supporting an arm of the occupant. The upper body support includes a rigid base member that has a front end, a back end, a tray ledge extending between the front end and the back end, and at least one slot for receiving a strap therethrough. A padded backwall is releasably mounted on the base member such that the backwall can be released from the base member if the occupant desires to use the arm to operate the wheelchair. The backwall simultaneously provides support for the occupant and prevents the arm from sliding off the upper body support when the arm is leaned thereon. A padded sidewall is integrally formed with the base member and is flush with one side of the wheelchair to allow unimpeded movement of the wheelchair through tight spaces, such as doorways. The sidewall simultaneously provides support for the occupant and prevents the occupant's arm from sliding off the upper body support when the arm is leaned thereon. At least one bracket is provided for securing the upper body support to one of the spaced-apart armrest and further prevents rotational movement of the upper body support thereabout. The bracket is attached to the base member. The upper body support further includes a pad releasably attached to the base member, preferably by one or more strips of hook and loop fasteners, and is adaptable to cover the tray ledge. The upper body support also includes a bracket attached between the base member and the back of the wheelchair to prevent fore and aft movement of the upper body supports on one of the axially spaced armrests. The base member of the upper body support is adaptable to receive the backwall at the first end or second end, preferably by a bolt and wing-nut fastener.

The present invention further includes an improved wheelchair for supporting the arm of the occupant. The wheelchair includes two upper body supports as described above. The wheelchair further includes at least two wheels for imparting movement to the wheelchair, which are rotationally mounted thereon. Two axially spaced support bars are also included on the wheelchair as well as a back attached between the support bars. The wheelchair further includes two spaced-apart armrests attached to the wheelchair for supporting the arm of the occupant.

Other objects, features and advantages of the present invention will become apparent by reference to the following detailed description when considered in conjunction with the accompanying drawings.

BRIEF DESCRIPTION OF THE DRAWINGS

The above and other features, aspects, and advantages of the present invention will now be discussed in the following detailed description and appended claims considered in conjunction with the accompanying drawings in which:

DETAILED DESCRIPTION OF THE PREFERRED EMBODIMENTS

Figure 1:
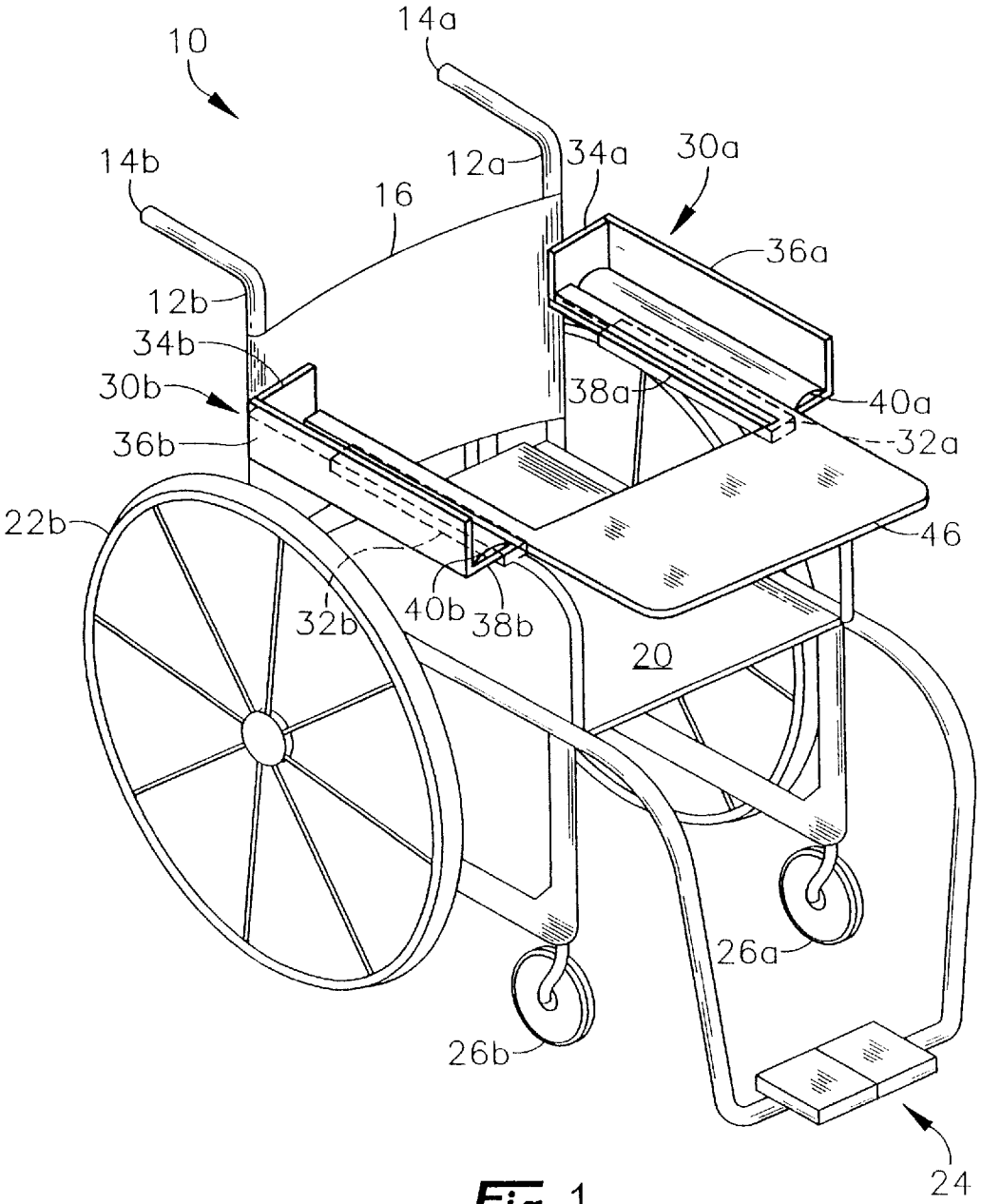
FIG. 1 is a perspective view of a wheelchair with an upper body support secured thereon in accordance with the present invention.
Figure 4:
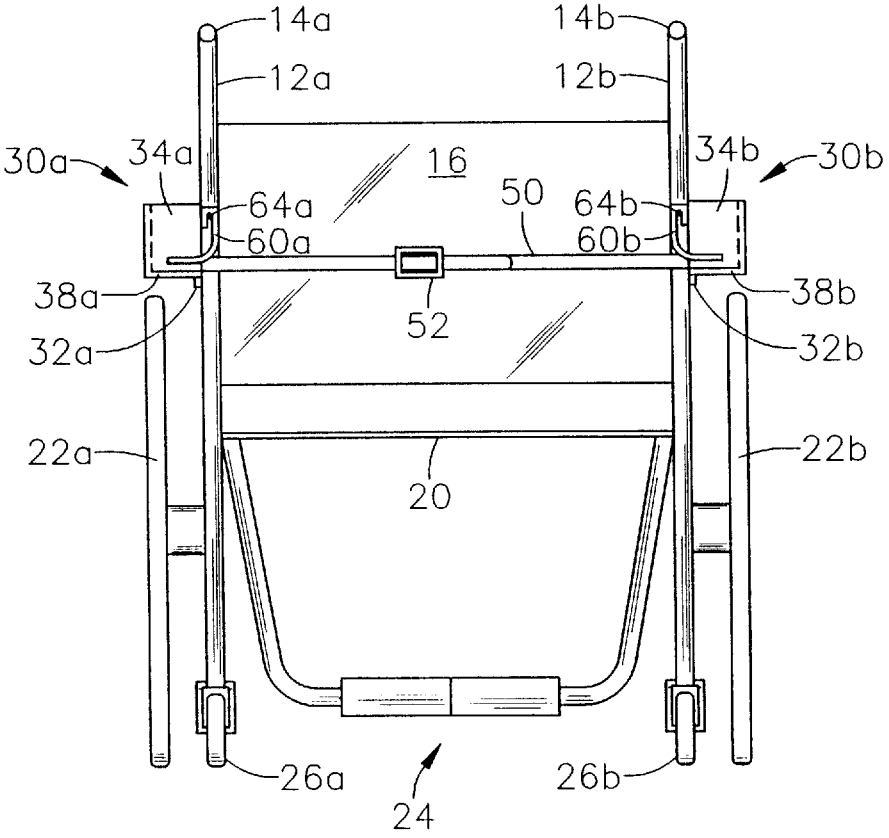
FIG. 4 is a side view of the back of the wheelchair.

With reference now to the drawings in which like reference characters designate like or similar elements throughout the several views, FIG. 1 shows an improved wheelchair 10 for providing both safety and comfort for the wheelchair occupant. The wheelchair 10 includes two back wheels 22*a* and 22*b* and two front wheels 26*a* and 26*b* for imparting movement to the wheelchair 10 and that are rotationally mounted thereon. Two axially spaced support bars 12*a* and 12*b* are also mounted on the wheelchair 10. A preferably canvas back 16, or one consisting of the material polyvinyl chloride ("PVC"), is attached between the support bars 12*a* and 12*b* for supporting the back of the occupant. As shown in FIG. 4, the back 16 is attached to the support bars 12*a* and 12*b* by screws or bolts 64*a* and 64*b*. Handles 14*a* and 14*b* extend from the support bars 12*a* and 12*b*, respectively so that wheelchair movement may be controlled by a non-occupant. The wheelchair 10 further includes a seat 20 on which the occupant sits and includes two spaced-apart armrests 32*a* and 32*b* attached to the wheelchair 10. The wheelchair 10 further includes a footrest 24 for the occupant.

Figure 2:
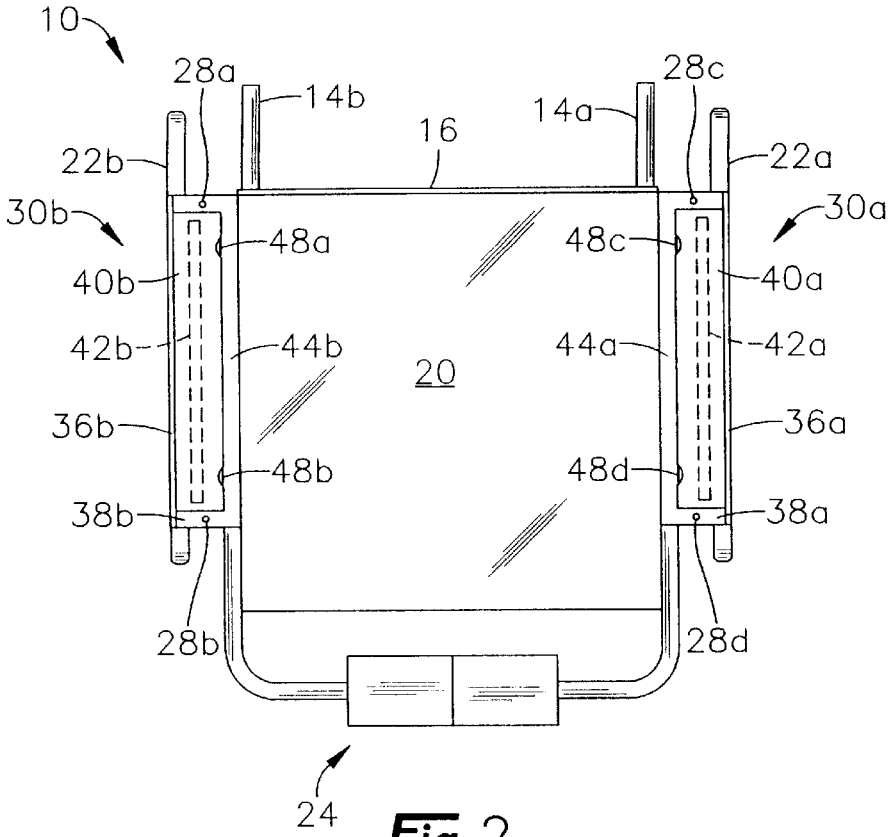
FIG. 2 is a plan view of the wheelchair shown in FIG. 1.
Figure 3:
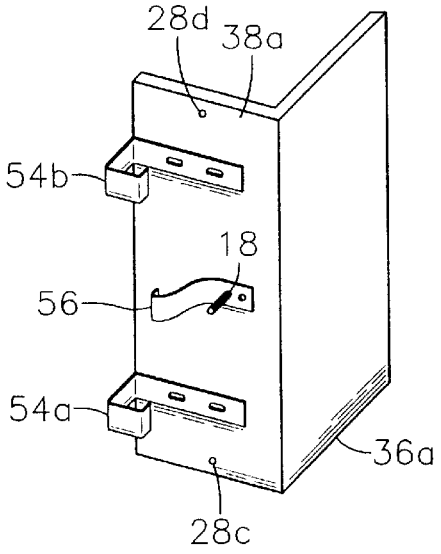
FIG. 3 is a perspective view of the left upper body support showing brackets employed for attaching the upper body support to the wheelchair.

As shown in FIGS. 1, 3, and 4, the present invention further includes upper body supports 30*a* and 30*b*, which are mounted on separate spaced-apart armrests 32*a* and 32*b* (FIGS. 1 and 4), for supporting the arms and upper torso of the occupant. The upper body supports 30*a* and 30*b* are preferably constructed of vinyl material, but can also be constructed of other stain-proof, water resistant material such as nylon, polypropalene, or PVC. The upper body supports 30*a* and 30*b* include base members 38*a* and 38*b*, respectively, which are preferably rigid and have a front end and a back end. As is best shown in FIG. 2, the rigid base members 38*a* and 38*b* have tray ledges 44*a* and 44*b*, respectively that extend between the front end and back ends. The tray ledges 44*a* and 44*b* are configured to receive a portion of a tray 46 (FIG. 1) which is typically used for supporting articles such as food items. The tray 46 is preferably padded near the arms of the occupant for comfort. The padding is preferably a fire retardant sponge, which meets standards of the occupational safety and health administration (OSHA) such as SOLIMIDE, a polyimide foam manufactured by the Ethyl Corporation.

Disposed within each of the upper body supports 30*a* and 30*b* are preferably two tray retention slots for receiving a strap which is attached at one end to the tray 46. The tray includes a hook and loop fastener to which the other end of each strap is attached. The tray 46 is secured to the upper body supports 30*a* and 30*b* by inserting each strap through its respective slots 48*a*, 48*b*, 48*c* and 48*d* and then wrapping the straps around their respective armrests 32*a* and 32*b*, corresponding to the particular side of the wheelchair 10 where the slots 48*a*, 48*b*, 48*c*, and 48*d* are positioned. As shown in FIG. 4, a back strap 50 is also provided on both ends of the tray 46, which traverses the back 16 of the wheelchair 10 and is secured together by a fastener 52, which is preferably a hook and loop fastener but could also be a belt buckle, or other belt retention device.

The present invention further provides means for securing the armrest bays 30*a* and 30*b* to one of the spaced-apart armrests 32*a* and 32*b*, respectively. These means can employ straps, or an integrally molded piece attached to the base members 38*a* and 38*b*, which fits over the armrests 32*a* and 32*b*, respectively. Preferably, however, the means include J-shaped brackets 54*a* and 54*b* for hooking around the armrests 32*a* and 32*b*, as shown in FIG. 3. The securing means can also include a third J-shaped attachment member 56 for hooking around the armrests 32*a* and 32*b*. The J-shaped attachment member 56 is preferably attached to the base members 38*a* and 38*b* via a bolt 18 and wing-nut fastener. The J-shaped brackets 54*a* and 54*b* are preferably, slidably adjustable to adjust for various widths of the armrests 32*a* and 32*b*. The J-shaped brackets 54*a* and 54*b* and the J-shaped attachment member 56 prevent rotational movement of the upper body supports 30*a* and 30*b* about the armrests 32*a* and 32*b*, respectively.

As shown in FIG. 4, brackets 60*a* and 60*b* are attached between the wheelchair 10 and the base members 38*a* and 38*b*, respectively, to prevent fore and aft movement of the upper body supports 30*a* and 30*b* along the spaced-apart armrests 32*a* and 32*b*. The brackets 60*a* and 60*b* can be attached to the wheelchair 10 with no physical modifications being made to the wheelchair 10. For example, the screws that typically hold the back 16 of the wheelchair 10 to the support bars 12*a* and 12*b* can be replaced with a bolt having a flared head 64*a* and 64*b* for attaching the bracket 60*a* and 60*b* to the wheelchair 10. The brackets 60*a* and 60*b* are preferably attached to the base members 38*a* and 38*b* by screws or bolts and wing-nut fasteners. The brackets 60*a* and 60*b* can also be attached between the sidewalls 36*a* and 36*b* and the bolts 64*a* and 64*b*, respectively.

Each of the upper body supports 30*a* and 30*b* further include backwalls 34*a* and 34*b*, respectively, for simultaneously providing support for the occupant and preventing the arm of the occupant from sliding off the upper body supports 30*a* and 30*b* when the arm is leaning thereon. The backwalls 34*a* and 34*b* are preferably padded with a fire retardant sponge material that meets OSHA standards. The padded backwalls 34*a* and 34*b* significantly enhances the comfort of the wheelchair occupant and reduces the likelihood of bruises and abrasions which otherwise could occur from rigorous contact with the hard surfaced wheelchair armrests 32*a*, 32*b*. Also preferably, the backwalls 34*a* and 34*b* are releasably mounted on the base members 38*a* and 38*b* such that the backwalls 34*a* and 34*b* can be released from the base members 38*a* and 38*b*, respectively, if the occupant desires to use his arms to self-propel the wheelchair 10. As shown in FIGS. 2 and 3, apertures 28*a* and 28*b* are preferably disposed in the base member 38*a* and apertures 28*c* and 28*d* are disposed in base member 38*b* and are used to releasably mount the padded backwalls 34*a* and 34*b* to the base members 38*a* and 38*b*, respectively, by having a bolt attached to the backwalls 34*a* and 34*b* inserted through apertures 28*a* and 28*c*, respectively, and fastened thereto by wing-nut fasteners. It is also understood, however, that the backwalls 34*a* and 34*b* could be attached to the base members 38*a* and 38*b*, respectively, via hook and loop fasteners or other types of fasteners.

The upper body supports 30*a* and 30*b* further include pads 40*a* and 40*b*, respectively, that is releasably attached to the base members 38*a* and 38*b* via hook and loop fasteners 42*a* and 42*b*. It is understood, however, that other means may be used to releasably attach the pads 40*a*, 40*b* to the base members 38*a*, 38*b*. For example, the pads 40*a* and 40*b* can also be releasably attached to the base members 38*a* and 38*b*, respectively, by means of a threaded bolt which is secured to the pads 40*a*, 40*b* and is positioned to be inserted through the base members 38*a* and 38*b* and attached thereto via wing-nut fasteners. To further enhance safety aspects of the invention, the pads 40*a* and 40*b* are preferably made of fire retardant sponge meeting OSHA standards.

If the tray 46 is not desired to be used by the occupant of the wheelchair 10, the pads 40*a* and 40*b* can be released from their positions shown in FIG. 2 and rotated 180° to cover the tray ledges 44*a* and 44*b*, respectively. This will also have the effect of covering the strap slots 48*a*, 48*b*, 48*c*, and 48*d*, thereby making the upper body supports 30*a* and 30*b* more aesthetically pleasing. It is further understood that each of the pads 40*a* and 40*b* can be integrally molded into their respective base members 38*a* and 38*b*.

The upper body supports 30*a* and 30*b* have a special adaptability feature to enhance manufacturability and reduce manufacturing costs. The upper body supports 30*a*, 30*b* are configured such that only one upper body support mold or type is required. For instance, apertures 28*a* and 28*b*, and 28*c* and 28*d* are disposed in the base members 38*a* and 38*b*, respectively, so that the backwalls 34*a* and 34*b* can be installed in either of the apertures, therefor requiring that only one physical shape of upper body support be manufactured.

The upper body supports 30*a* and 30*b* further include sidewalls 36*a* and 36*b*, which are preferably integrally formed with the base members 38*a* and 38*b*, respectively. The sidewalls 36*a* and 36*b* can also be attached to the base members 38*a* and 38*b*, respectively, via hook and loop fasteners or a bolt attached to the sidewalls 36*a* and 36*b* extending through the base members 38*a* and 38*b*, respectively, and tightened with wing-nut fasteners.

Furthermore, the sidewalls 36*a* and 36*b* are preferably flush with or inboard from the sides of the wheelchair, such as the back wheels 22*a* and 22*b*, so that the upper body supports 30*a* and 30*b* do not increase the width of the wheelchair 10. In this manner the upper body supports 30*a*, 30*b* do not impede movement of the wheelchair 10 in tight spaces such as door wells. The sidewalls 36*a* and 36*b* are preferably padded with a fire retardant sponge, which meets with OSHA standards, and provides cushioning support while reducing the likelihood of bruises and abrasions to the arms of the occupant. The sidewalls 36*a* and 36*b* simultaneously provide support for the occupant and prevent the arms of the occupant from sliding off the upper body supports 30*a* and 30*b* when the arm of the occupant is leaning thereon.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. Therefore, the above mentioned description is to be considered exemplary, rather than limiting, and the true scope of the invention is that defined in the following claims.

What is claimed is:

1. A wheelchair having front wheels, back wheels, a back, and two spaced-apart armrests where each of said armrests includes a back end adjacent the back and a front end extending from the back end toward the front wheels, the wheelchair comprising:

two upper body supports for enhancing occupant support and safety, one of said upper body supports being attached to one of the spaced-apart armrests and the other upper body support being attached to the other spaced-apart armrest, each upper body support including:

a base member having a front edge adjacent the front end of an armrest, a back edge adjacent the back end of an armrest, an inboard edge, and an outboard edge extending outwardly from the inboard edge, said base member for supporting an arm of the occupant;

a backwall attached to the back edge of the base member, the backwall simultaneously providing support for the occupant and preventing the arm from sliding off the base member when the arm is leaned thereon;

a sidewall attached to the outboard edge of the base member, the sidewall simultaneously providing support for the occupant and preventing the arm from sliding off the base member when the arm is leaned thereon; and means for securing the upper body support to one of the spaced-apart armrests so that the backwall is adjacent the back of the wheelchair and the inboard edge of the base member is adjacent the occupant.

2. The wheelchair of claim 1 wherein the base member further includes at least one tray retention slot formed therein.

3. The wheelchair of claim 1 wherein the backwall is releasably mounted on the base member such that the backwall can be released from the base member if the occupant desires to use the arm to operate one of the wheels of the wheelchair.

4. The wheelchair of claim 1 wherein the sidewall is integrally formed with the base member.

5. The wheelchair of claim 1 wherein the means for securing the upper body support to one of the spaced-apart armrests includes at least one bracket attached to the base member.

6. The wheelchair of claim 1 further comprising a tray having a back strap attached thereto for encircling the back of the wheelchair.

7. The wheelchair of claim 1 wherein the base member further includes a tray ledge extending between the front edge and the back edge of the base member.

8. The wheelchair of claim 7 wherein the upper body support further includes a pad releasably attached to the base member and adaptable to cover the tray ledge.

9. An upper support for supporting an arm of an occupant of a wheelchair having front wheels, a back, and two spaced-apart armrests where each of said armrests includes a back end adjacent the back and a front end extending from the back end toward the front wheels, the upper body support comprising:

a base member having a front edge adjacent the front end of an armrest, a back edge adjacent the back end of an armrest, an inboard edge, an outboard edge extending outwardly from the inboard edge, and a tray ledge extending between the front edge and back edge of the base member, said base member for supporting an arm of the occupant;

a padded backwall attached to the back edge of the base member, the backwall simultaneously providing support for the occupant and preventing the arm from sliding off the base member when the arm is leaned thereon;

a padded sidewall attached to tie outboard edgy of the base member and simultaneously providing support for the occupant and preventing the arm from sliding off the base member when the arm is leaned thereon: and means for securing the upper body support to one of the armrests.

10. An upper body support for supporting an arm of an occupant of a wheelchair having front wheels, back wheels, a back, and two spaced-apart armrests where each of said armrests includes a back end adjacent the back and a front end extending from the back end toward the front wheels, the upper body support comprising:

a base member having a front edge adjacent the front end of an armrest, a back edge adjacent the back end of an armrest, an inboard edge, and an outboard edge extending outwardly from the inboard edge, said base member for supporting an arm of the occupant;

a padded backwall attached to the back edge of the base member, the backwall simultaneously providing support for the occupant and preventing the arm from sliding off the base member when the arm is leaned thereon;

a padded sidewall attached to the outboard edge of the base member and simultaneously providing support for the occupant and preventing the arm from sliding off the base member when the arm is leaned thereon; and means for securing the upper body support to one of the armrests;

wherein the backwall is releasably mounted on the base member such that the backwall can be released from the base member if the occupant desires to use the at least one arm to operate one of the wheels of the wheelchair.

11. An upper body support for supporting an arm of an occupant of a wheelchair having front wheels, back wheels, a back, and two spaced-apart armrests where each of said armrest includes a back end adjacent the back and a front end extending from the back end toward the front wheels, the upper body support comprising;

a base member having a front edge adjacent the front end of an armrest, a back edge adjacent the back end of an armrest, an inboard edge, an outboard edge extending outwardly from the inboard edge, and a tray ledge extending between the front edge and the back edge of the base member said base member for supporting an arm of the occupant;

a padded backwall attached to the back edge of the base member, the backwall simultaneously providing support for occupant and preventing the arm from sliding off the base member when the arm is leaned thereon;

a padded sidewall attached to the outboard edge of the base member and simultaneously providing support for the occupant and preventing the arm from sliding off the base member when the arm is leaned thereon;

means for securing the upper body support to one of the armrests; and a pad releasably attached to the base member and adaptable to cover the tray ledge.

12. An upper body support for supporting an arm of an occupant of a wheelchair having front wheels, back wheels, a back, and two spaced-apart armrests where each of said armrests includes a back end adjacent the back and a front end extending from the back end toward the front wheels, the upper body support comprising;

a base member having a front edge adjacent the front end of an armrest, a back edge adjacent the back end of an armrest, an inboard edge, and an outboard edge extending outwardly from the inboard edge, said base member for supporting an arm of the occupant;

a padded backwall attached to the back edge of the base member, the backwall simultaneously providing support for the occupant and preventing the arm from sliding off the base member when the arm is leaned thereon;

a padded sidewall attached to the outboard edge of the base member and simultaneously providing support for the occupant and preventing the arm from sliding off the base member when the arm is leaned thereon;

means for securing the upper body support to one of the armrests; and a tray having a back strap attached thereto for encircling the back of the wheelchair.

13. An upper body support for supporting an arm of an occupant of a wheelchair having front wheels, back wheels, a back, and two spaced-apart armrests where each of said armrests includes a back end adjacent the back and a front end extending from the back end toward the front wheels, the upper body support comprising:

a base member having a front edge adjacent the front end of an armrest, a back edge adjacent the back end of an armrest, an inboard edge, an outboard edge extending outwardly from the inboard edge, and at least one tray retention slot, said base member for supporting an arm of the occupant;

a padded backwall attached to the back edge of the base member, the backwall simultaneously providing support for the occupant and preventing the arm from sliding off the base member when the arm is leaned thereon;

a padded sidewall attached to the outboard edge of the base member and simultaneously providing support for the occupant and preventing the arm from sliding off the base member when the arm is leaned thereon; and means for securing the upper body support to one of the arrests.

14. An upper body support for supporting an arm of an occupant of a wheelchair having two spaced-apart armrests for supporting an arm of the occupant, the upper body support being attachable to one of the spaced-apart armrests, said upper body support comprising:

a rigid base member having a front end, a back end, a tray ledge extending between the front end and the back end, and at least one slot for receiving a strap therethrough;

a padded backwall releasably mounted on the base member such that the backwall can be released from the base member if the occupant desires to use the arm to operate the wheelchair, the backwall simultaneously providing support for the occupant and preventing the arm from sliding off the upper body support when the arm is leaned thereon;

a padded sidewall integrally formed with the base member and being flush with one side of the wheelchair when the upper body support is attached to an armrest of the wheelchair, the sidewall simultaneously providing support for the occupant and preventing the arm from sliding off the upper body support when the arm is leaned thereon;

at least one bracket for securing the upper body support to one of the spaced-apart armrests and preventing rotational movement thereabout, the at least one bracket being attached to the base member;

a pad releasably attached to the base member and adaptable to cover the tray ledge;

a bracket for securing the base member to the wheelchair to prevent fore and aft movement of the upper body support on one of the spaced-apart armrests; and the base member being adaptable to receive the backwall at the first end and second end.

* * * * *

UNITED STATES PATENT AND TRADEMARK OFFICE

CERTIFICATE OF CORRECTION

PATENT NO. : 5,842,745

DATED : December 1, 1998

INVENTOR(S) : Kelly, et al.

It is certified that error appears in the above-identified patent and that said Letters Patent is hereby corrected as shown below:

Column 6, line 11, after "wheels," insert --back wheels -- .

Column 6, line 28, delete "tie" and insert therefor --the--.

Column 6, line 28, delete "edgy" and insert therefor --edge--.

Column 7, line 10, after "for" insert --the--.

Column 8, line 15, delete "arrests" and insert therefor --armrests--.

Signed and Sealed this

Seventeenth Day of August, 1999

*Attest:*

Q. TODD DICKINSON

*Attesting Officer*

*Acting Commissioner of Patents and Trademarks*